US006186310B1

(12) United States Patent
Waldecker et al.

(10) Patent No.: US 6,186,310 B1
(45) Date of Patent: Feb. 13, 2001

(54) COIN ESCROW APPARATUS

(75) Inventors: Manfred Waldecker, Lawrenceville, GA (US); David K. Lehman, Punta Gorda, FL (US)

(73) Assignee: Elcotel, Inc., Sarasota, FL (US)

( * ) Notice: Under 35 U.S.C. 154(b), the term of this patent shall be extended for 0 days.

(21) Appl. No.: 09/312,048

(22) Filed: May 14, 1999

(51) Int. Cl.[7] ..... G07D 1/00

(52) U.S. Cl. ..... 194/346; 232/57.5

(58) Field of Search ..... 194/346; 379/150, 379/151, 152, 153; 232/57.5

(56) References Cited

U.S. PATENT DOCUMENTS

| | | | | |
|---|---|---|---|---|
| 1,098,673 | * | 6/1914 | Lyng | 194/346 X |
| 4,399,902 | | 8/1983 | Holland et al. . | |
| 4,782,937 | | 11/1988 | Chen et al. | 194/346 |
| 5,064,116 | | 11/1991 | McGough et al. | 194/346 X |

FOREIGN PATENT DOCUMENTS

WO 98/05156 2/1998 (WO) .

* cited by examiner

*Primary Examiner*—F. J. Bartuska
(74) *Attorney, Agent, or Firm*—Schnader Harrison Segal & Lewis LLP

(57) ABSTRACT

A coin escrow apparatus for use with pay telephones including side members at least partially defining a coin hopper, a door mounted between the side members for selective movement between an escrow position for supporting coins in the hopper, an acceptance position for releasing coins from the hopper in a first direction, and a return position for releasing coins from the hopper in a second direction. The door has an underside portion and one or more guides associated with the door for guiding the door for pivotal movement between the escrow, acceptance and return positions. A support member is pivotally positioned below the door and has an upper portion. The support member is capable of pivoting about a pivot axis below the door. One or more roller bearings is attached to the upper portion of the support member for engaging the underside of the door. An actuator for pivoting the support member is also provided.

4 Claims, 6 Drawing Sheets

COIN ESCROW APPARATUS

FIELD OF THE INVENTION

The invention generally relates to a coin escrow apparatus. More particularly, the invention relates to an improved coin escrow apparatus for use in coin-operated telephones and the like, capable of handling a large number of coins and delivering these coins to either a coin return or a cash box.

BACKGROUND OF THE INVENTION

Coin operated systems such as pay telephones typically include coin escrow devices which temporarily hold deposited coins until a determination is made as to whether the coins should be returned to the system user or collected in the systems coin box. A pay telephone, for example, releases coins to a coin box in the event that a call has been successfully placed or returns coins to the calling party in the event that a call is not successfully connected to a called party.

A primary requirement for a coin escrow device is reliability. A commercial coin escrow device must properly operate to discharge all escrowed coins to a coin box only when a transaction has been successfully completed and, conversely, must return all escrowed coins to the system user when a transaction has not been successfully completed or canceled. If a coin escrow device does not operate reliably, the vending system may be damaged by an irate user and revenue will be lost to the owner of the system.

Additionally, a coin escrow must be able to hold a large number of coins while resisting jamming and without causing erroneous discharge of the coins. The number of coins in a coin escrow can cause a significant variation in the amount of friction between bearing points of a coin escrow device. Some coin escrow devices, for example are required to hold a minimum of forty coins or more. A coin-operated system which is subject to jamming is likely to incur substantial down-time which results in dissatisfaction of users and requires costly additional maintenance.

A further requirement for many coin escrow devices is low power consumption. In certain applications, such as pay telephones, the drive power for the device is derived from a limited line power supply. Low cost is also an important requirement in most applications for which coin escrows are used.

PCT Application No. WO1997US13421 to Faes et al. discloses a coin escrow apparatus for pay telephones. The apparatus described in the Faes et al. application includes a housing defining a coin hopper, a coin acceptance chute, a coin return chute, and a door mounted within the housing for selective movement between an escrow position, an acceptance position and a return position. The apparatus also includes structures for selectively moving the door between its escrow, acceptance, and return positions. These structures include elements for guiding the door for pivotal movement, a pivotal support member element and an actuator for pivoting the pivotal support member element. The apparatus disclosed in Faes et al. uses friction points between the door and the pivotal support member element. This apparatus tends to suffer from the reliability problems discussed above and is susceptible to jamming. Accordingly, a longstanding need still remains for a coin escrow device which is reliable and resists jamming over a lengthy service life for the telephone.

SUMMARY OF THE INVENTION

The invention relates to an improved coin escrow apparatus for use with a pay telephone. The coin escrow apparatus includes side members which partially define a coin hopper. The coin escrow apparatus also includes a door defining the floor of the coin hopper mounted between the side members for selective movement between a coin escrow position for supporting coins in the hopper, an acceptance position for releasing coins from the hopper in a first direction, and a return position for releasing coins from the hopper in a second direction. The door has first and second end portions and an underside portion. Attached to the door is one or more guides for selectively pivoting the door.

The apparatus also includes a support member pivotally positioned below the door and having an upper portion. The support member also includes one or more roller bearings associated with the upper portion thereof. Further, an actuator is provided for pivoting the support member. The side members and the door are preferably constructed to provide a coin hopper capable of holding a large volume of coins.

The foregoing advantages of the invention can readily be ascertained by reference to the following description and attached drawings which illustrate preferred embodiments.

DETAILED DESCRIPTION OF THE INVENTION

Figure 1:
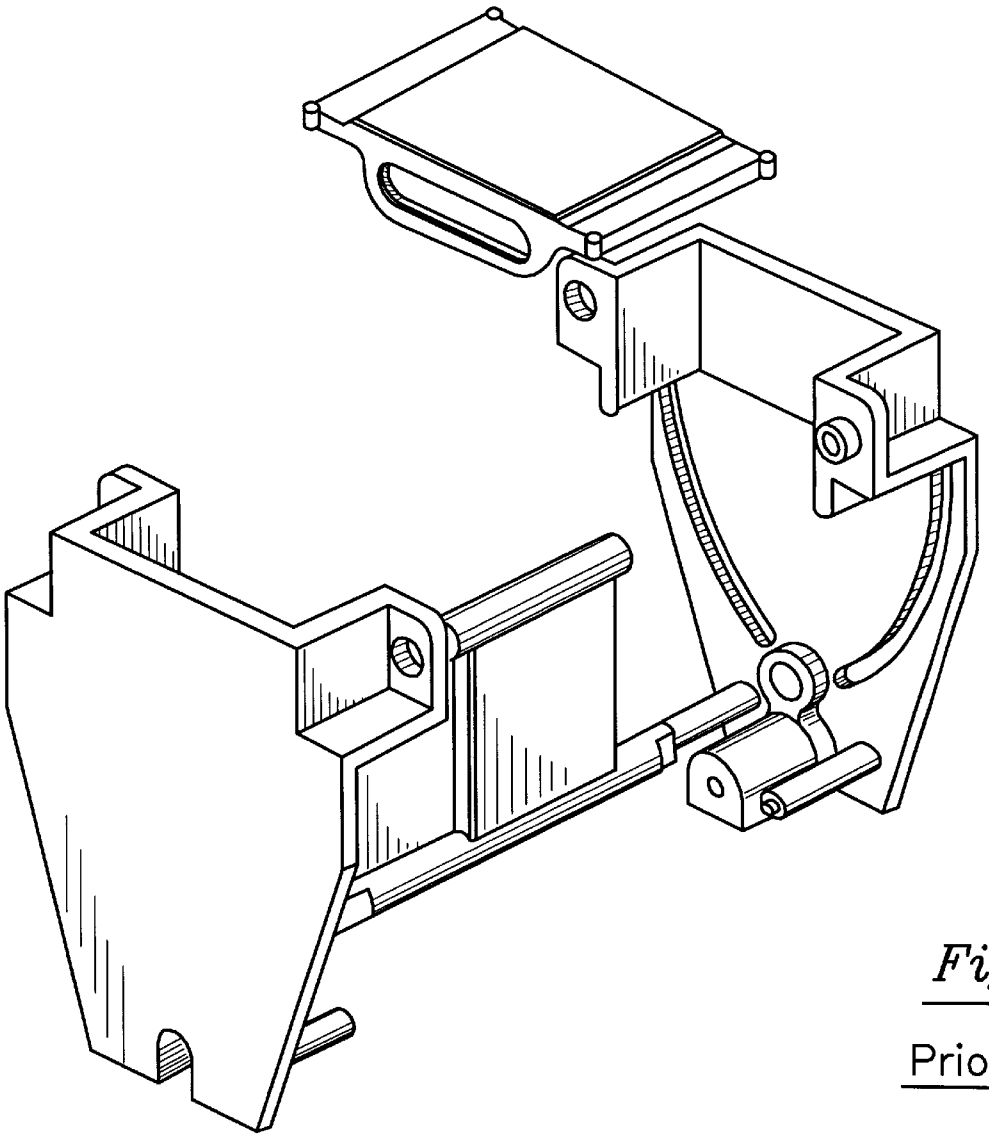
Fig. 1 Prior Art
FIG. 1 is an enlarged perspective view of a portion of a prior art coin escrow apparatus broken apart into its component pieces.
Figure 2:
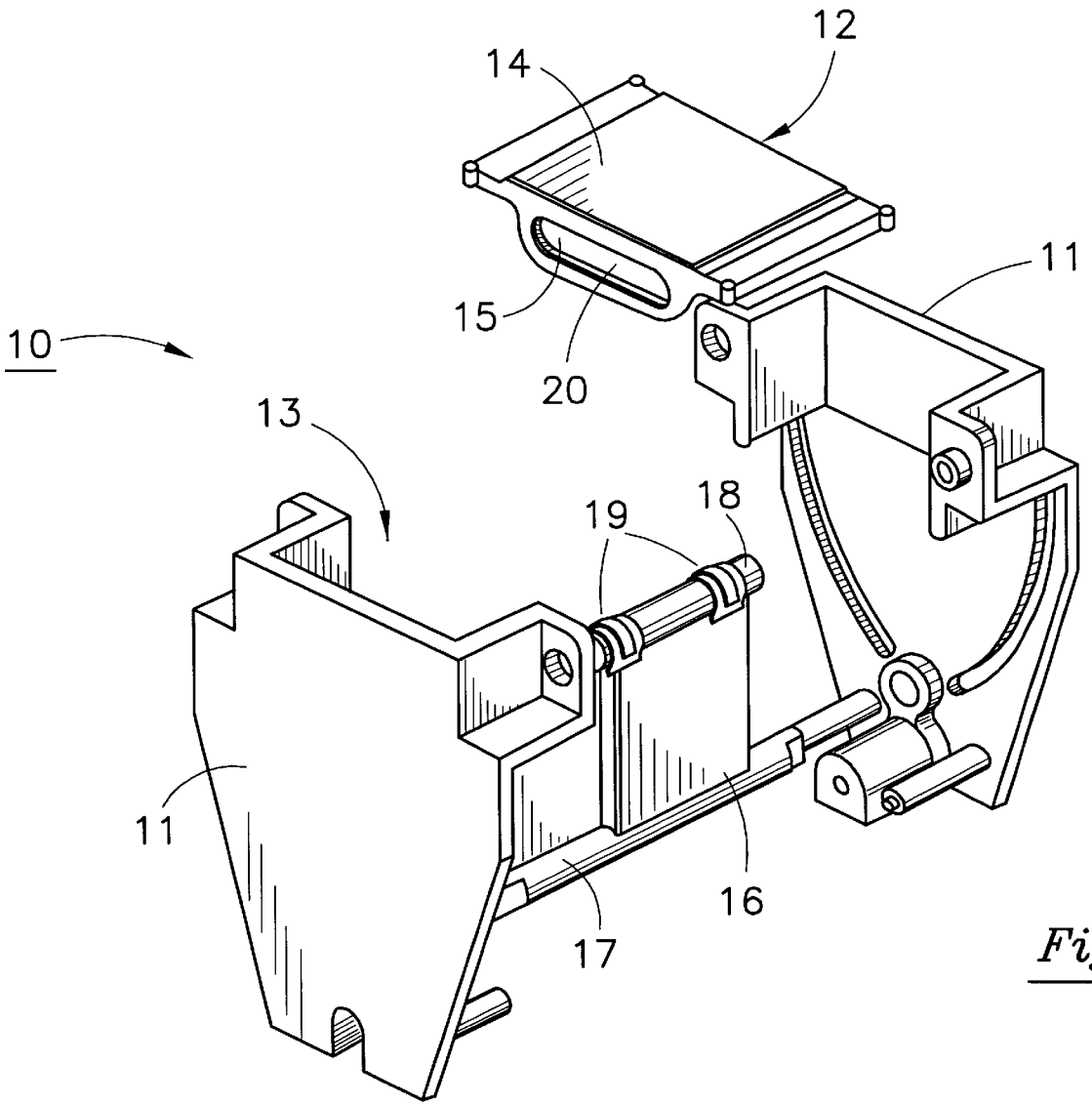
FIG. 2 is an enlarged perspective view of a preferred embodiment of the invention broken apart into its component pieces.
Figure 3:
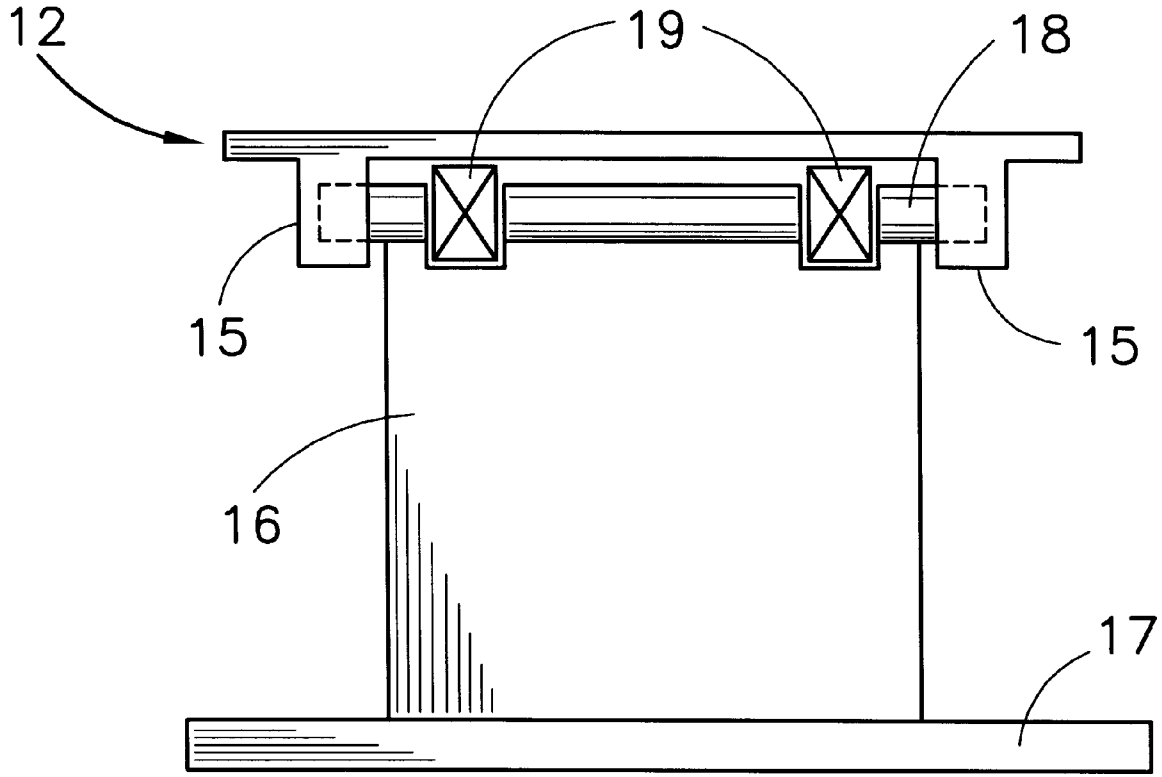
FIG. 3 is a side elevational view of a portion of the preferred embodiment of the invention from FIG. 2 showing the door, support member and roller bearings in an escrow position.

FIG. 1 shows a coin escrow apparatus representative of the prior art. FIGS. 2 and 3 show a coin escrow apparatus 10 according to a preferred embodiment of the invention wherein like reference numerals represent like parts throughout the several views.

Figure 4:
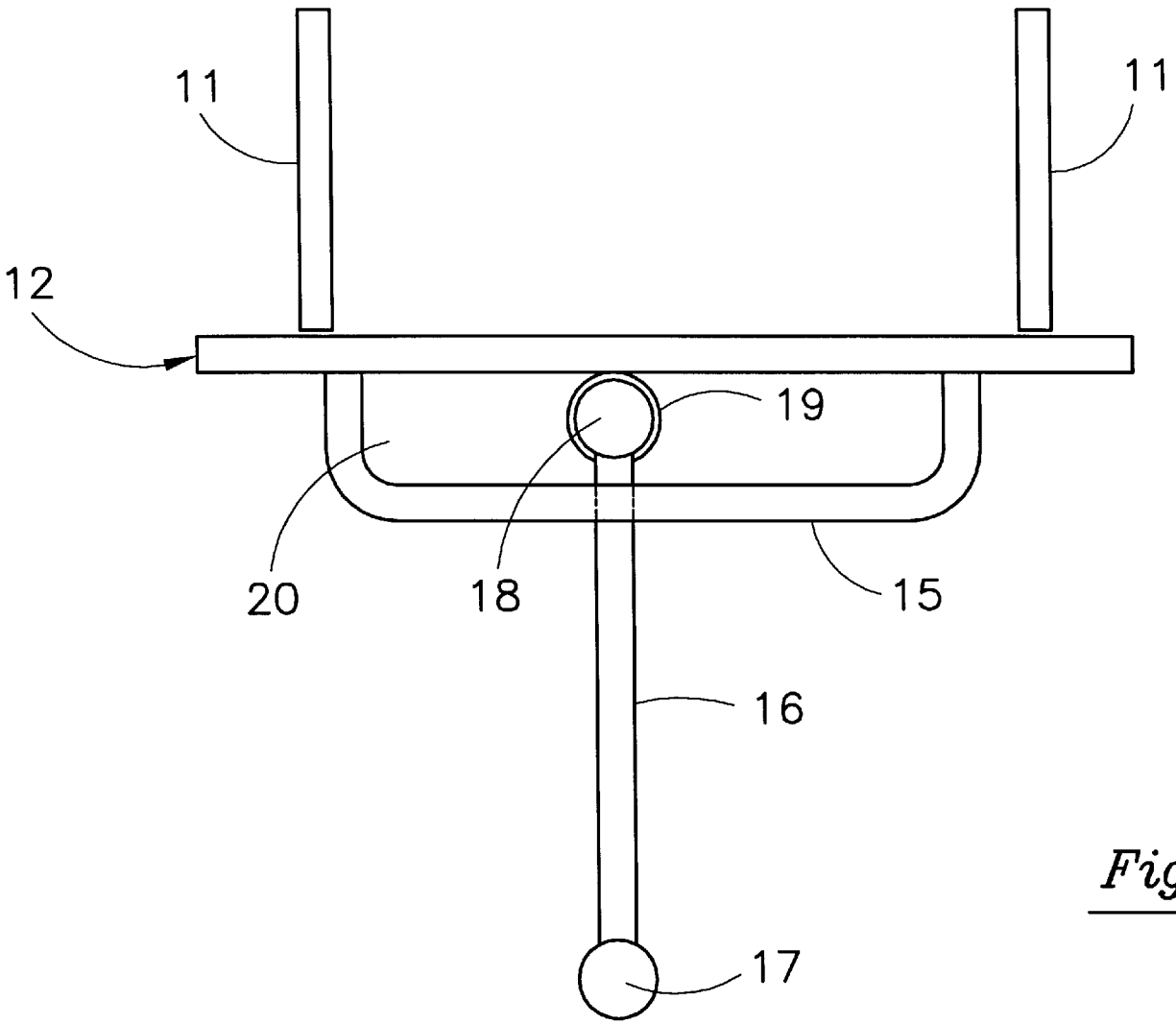
FIG. 4 is an end elevational side view of a portion of the apparatus shown in FIG. 2.
Figure 5:
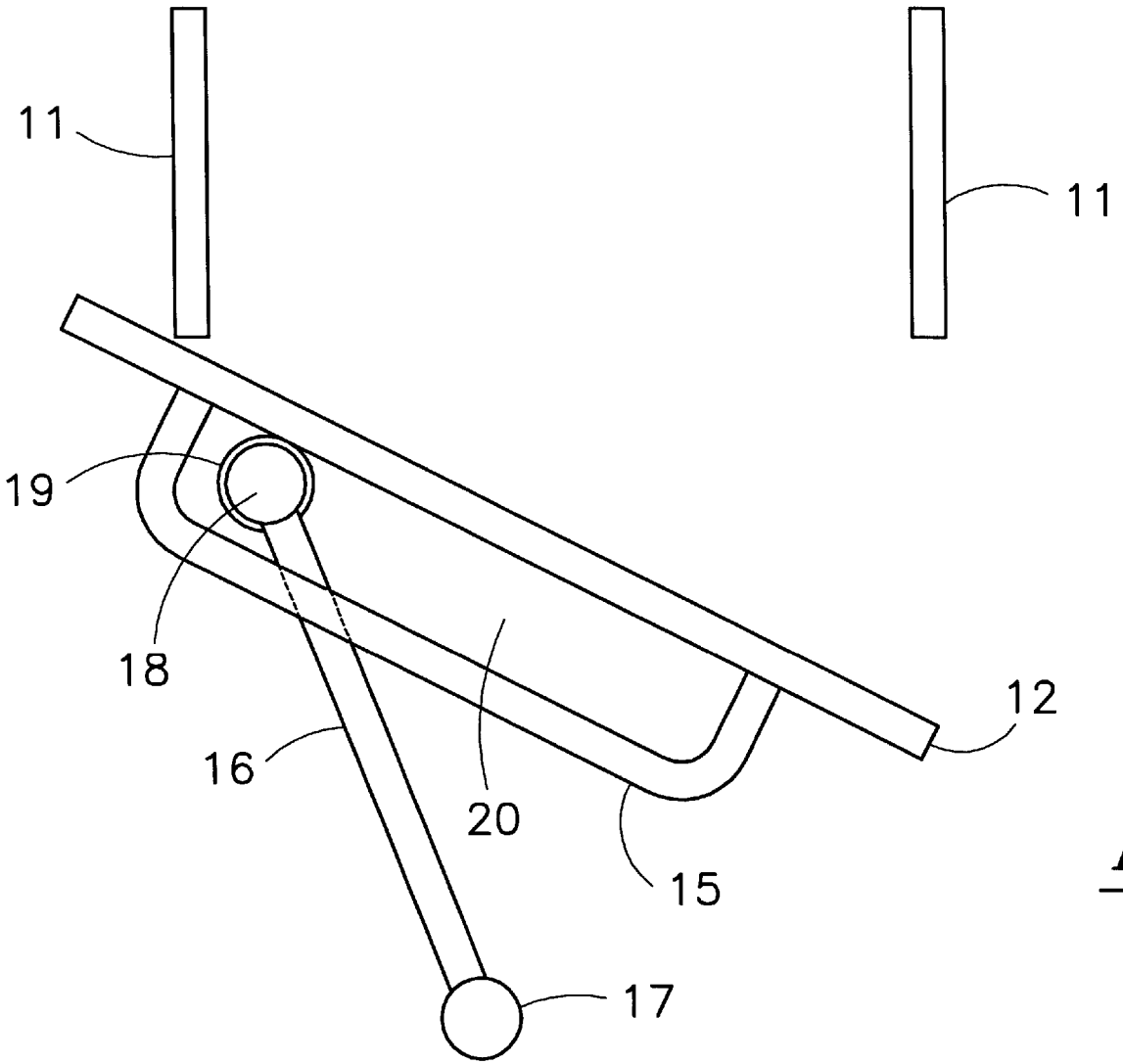
FIG. 5 is an end elevational view of a portion of the apparatus shown in FIG. 2 in a coin acceptance position.
Figure 6:
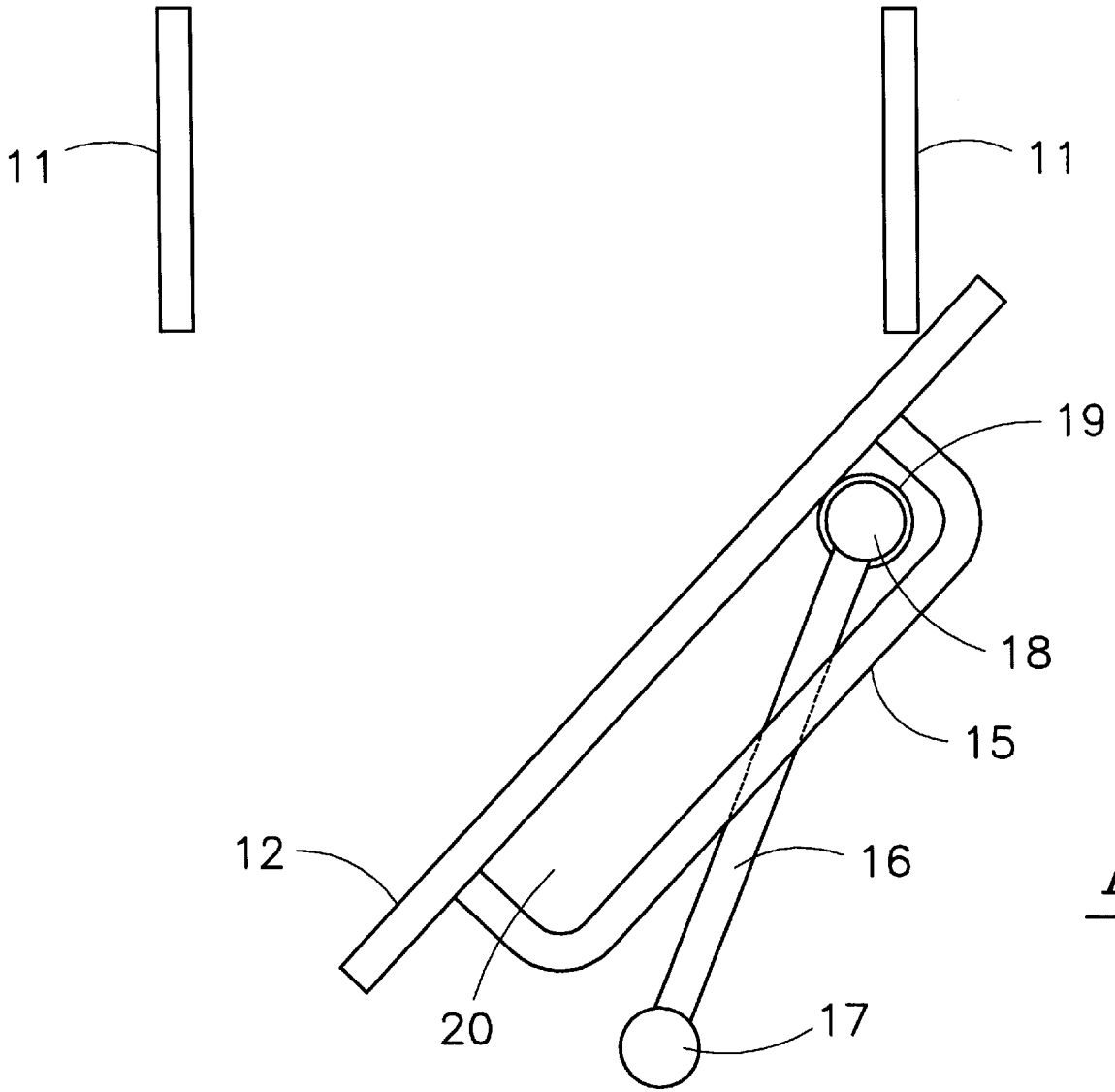
FIG. 6 is an end elevational view of a portion of the apparatus shown in FIG. 2 in a coin return position.

The coin escrow apparatus 10 includes side members 11 and a door 12 positioned between the side members 11. The side members 11 and the door 12 partially define an upper coin hopper 13. The side members 11 and door 12 are designed to hold a large volume of coins while still providing reliable resistance to self-actuation. Door 12 is movable between an escrow position (shown in FIGS. 3 and 4), a coin acceptance position (shown in FIG. 5), and a coin return position (shown in FIG. 6). The door 12 includes an upper surface 14 and guides 15 at the underside thereof. Guides 15 include openings 20, which will be discussed below.

A support member 16 is pivotally mounted between side members 11. The support member 16 is attached to pivot rod 17 and is capable of pivoting about a pivot axis below door 12. An actuator (not shown) may be attached to the pivot rod 17 for pivoting the support member 16. The actuator may include a solenoid for biasing the support member 16. The actuator may be mounted either horizontally or vertically relative to side members 11, and can be powered by any suitable control system commonly known or used in the art.

A cam portion 18 is formed at an upper end of the support member 16 and rides within openings 20 to translate pivotal motion of the support member 16 into pivotal motion of door 12. Support member 16 also includes one or more roller bearings 19 rotatably mounted on cam portion 18 for engagement with the underside of door 12.

Side members 11 may be made of any material commonly known or used in the art and can be assembled using screws or snap fitting fasteners. Side members 11 may also include coin chute surfaces (not shown) which define a coin acceptance chute and a coin return chute. Roller bearings 19 may be made of any suitable material such as steel or plastic, for example, and may be mounted in cam portion 18 using pins or any other mounting method sufficient to permit reliable, long term rolling action. Adaptors (not shown) may be used to mount the coin escrow apparatus 10 in pay phones of different manufacturers having various configurations.

The coin escrow apparatus according to the invention, has a number of advantages including a reduced power requirement for activation and excellent long term reliability. The roller bearings mounted in the upper portion of the support member reduce friction between the door and the support member. This reduced friction reduces the power required for activation and dispensing of the coins. Although the coin escrow apparatus can operate at very low power levels, it is very resistant to self-actuation. In the escrow position, the door is supported above the vertical support member on the roller bearings, making it virtually impossible for the weight of the coins contained in the hopper to open the door. Additionally, the roller bearings mounted in the upper portion of the support member contact the underside of door to provide improved resistance to jamming.

A magnet (not shown) may be mounted in cam portion 18 along with a corresponding metal element centrally mounted between side members 11 to provide a centering bias to the support member 16. This combination will help to return and maintain support member 16 to a vertical orientation as well as provide dynamic damping.

Although the present invention has been described with reference to preferred embodiments, it can be readily understood that the invention is not restricted to the preferred embodiments and that various changes and modifications can be made by those skilled in the art without departing from the spirit and scope of the invention.

What is claimed is:

1. A coin escrow apparatus comprising:

a plurality of side members at least partially defining a coin hopper;

a door mounted between said side members for selective movement between an escrow position for supporting coins in said hopper, an acceptance position for releasing coins from said hopper in a first direction, and a return position for releasing coins from said hopper in a second direction, said door having an underside portion;

one or more guides associated with said door providing guidance of said door between said positions;

a support member, having an upper portion, pivotally positioned below said door, said support member being capable of pivoting about a pivot axis below said door;

one or more roller bearings movably fixed to said upper portion of said support member and directly contacting and engaging said underside of said door; and an actuator for pivoting said support member.

2. A coin escrow apparatus as in claim 1, wherein said side members, said door, said support member, said one or more roller bearings and said actuator cooperate to selectively move said door between said escrow position for supporting coins in said hopper, said acceptance position for releasing coins from said hopper in said first direction, and said return position for releasing coins from said hopper in said second direction.

3. A coin escrow apparatus comprising:

a plurality of side members at least partially defining a coin hopper;

a door means mounted between said side members for selective movement between an escrow position for supporting coins in said hopper, an acceptance position for releasing coins from said hopper in a first direction, and a return position for releasing coins from said hopper in a second direction, said door having an underside portion;

guide means attached to said door for guiding said door for pivotal movement between said positions;

a support means, having an upper portion, pivotally positioned below said door means, said support means being capable of pivoting about a pivot axis below said door;

roller bearing means mounted on said upper portion of said pivotal support means for directly contacting and engaging said underside of said door means; and actuator means for pivoting said support means.

4. A coin escrow apparatus as in claim 3, wherein said side members, said door means, said support means, said roller bearing means and said actuator means cooperate to selectively move said door means between said escrow position for supporting coins in said hopper, said acceptance position for releasing coins from said hopper in said first direction, and said return position for releasing coins from said hopper in said second direction.

* * * * *